US008220306B2

(12) United States Patent
Van Essen

(10) Patent No.: US 8,220,306 B2
(45) Date of Patent: Jul. 17, 2012

(54) DIE ELEMENT

(75) Inventor: Frederick Hubert Van Essen, Williamstown (AU)

(73) Assignee: Betaswage Pty Ltd (AU)

( * ) Notice: Subject to any disclaimer, the term of this patent is extended or adjusted under 35 U.S.C. 154(b) by 142 days.

(21) Appl. No.: 12/775,891

(22) Filed: May 7, 2010

(65) Prior Publication Data

US 2011/0005294 A1 Jan. 13, 2011

(30) Foreign Application Priority Data

May 8, 2009 (AU) ..... 2009902037

(51) Int. Cl.
*B21D 41/00* (2006.01)

(52) U.S. Cl. ..... 72/402

(58) Field of Classification Search ..... 72/402, 72/413, 478

See application file for complete search history.

(56) References Cited

U.S. PATENT DOCUMENTS 6,484,553 B1 * 11/2002 Devers ..... 72/402
2002/0162379 A1 * 11/2002 Devers ..... 72/402

* cited by examiner

*Primary Examiner* — Faye Francis
(74) *Attorney, Agent, or Firm* — Alston & Bird LLP

(57) ABSTRACT

A die element configuration for use in a swaging or crimping press includes at least two cooperating die elements that, in use, are radially moved inwardly during a swaging or crimping process. Each die element has a body portion with a work element engaging surface located at a radially inner location on the body portion, the work element engaging surface having an axial direction and a circumferential direction transverse to the axial direction with the work engaging surface being concavely curved in the circumferential direction. The work engaging surface has a first central section extending axially with at least a pair of axially spaced first lateral sections and at least one second lateral section extending from the first central section oppositely to the first lateral sections, whereby a first lateral section of a first die element in the configuration is located axially adjacent a second lateral section of a second similarly formed die element.

17 Claims, 3 Drawing Sheets

DIE ELEMENT

FIELD OF THE INVENTION

The present invention relates to improvements in die elements for use in crimping or swaging machines, particularly but not necessarily exclusively of the kind intended to cold form by pressing metal collars, ferrules or the like onto hoses.

BACKGROUND TO THE INVENTION

Conventionally swaging or crimping presses employ die elements that are arranged around a work zone and are forced to move radially inwardly during a crimping or swaging operation to press against the metal collar, ferrule or the like. Conventionally die elements in such machines are selectably attachable to die shoes which are moved typically under high loads by a hydraulically operated piston acting simultaneously on all of the die shoes radially inwardly during a crimping or swaging process. Such machines and arrangements are described in Australian Patent Specification Nos. 2001276155, 2004900774 and 2006230741. Conventional die elements include a body portion with a radial inner work engaging surface that extends axially and has a concave curved surface transverse to the axial direction. In modern machines of this type, it is usual to provide eight such die elements circumferentially about the work zone but it is known to utilise any number of such cooperating die elements from two upwards including uneven numbers of the die elements. The die elements are generally removable so that they can be replaced with other types of die elements depending on the task required to be performed and the work element intended to be swaged or crimped. A collection of die elements to make up a complete arrangement may be termed a "die set" and typically a swaging or crimping press may be supplied with a variety of die sets that in a final inner position of the die elements will provide smaller or larger circumferences defined by the work element engaging surfaces. This enables work elements of differing sizes to be worked on and further to reduce the diameter of the work element (collar, ferrule or the like) gradually or in steps by utilising differing die sets. When the die elements of any die set are fully closed (radially innermost position), the internal diameter (termed "closure diameter") becomes the Die Set Number. Controlling the machine such that in the reduction process, the reduction operation stops at a defined distance from the closure diameter (termed "Offset Value"), provides a finished diameter of Die Set Number and Offset Value.

Each die set can with a limited range of Offset Values, crimp a ferrule/collar to a range of finished diameters limited by, the internal curvature of the work engaging surfaces of the die elements matching the performance requirements of the finished crimped ferrule/collar; the amount of ferrule surface area that is positioned between the die elements, not directly beneath the die element work engaging surface; and the final crimped ferrule/collar no longer having a general cylindrical shape. In the crimping process, the die elements move in radially, however, they contact the work element (ferrule, collar or the like) only at the axial edges of the die elements. As the die elements move further radially inwardly to the required final diameter, the work element strains in the following manner. Metal directly beneath the die element does not compress due to the contact on the edges of the die element because the curvature of the work engaging surface of the die is always smaller than the curvature of an uncrimped work element (ferrule or collar). Moreover, metal of the work element between the die elements is squeezed as the edges of the die elements, which have imprinted the work element surface, contract. This causes the work element metal to "balloon" both externally and internally in those regions. The final result is a ferrule that is distorted, especially internally where in most instances it is preferred that it provides a uniform radial squeeze onto the hose surface on which it is engaged.

SUMMARY OF THE INVENTION

The objective of the present invention is to provide a new design of die element that will enable, in cooperation with other such die elements, an improved performance of a crimping or swaging operation that avoids or at least minimises the above discussed problems with known machinery of this type. The objective is also to provide crimping or swaging machinery incorporating such an improved die element design.

Accordingly, the present invention provides a die element for a swaging or crimping press adapted, in use, to be moved radially inwardly during a swaging or crimping operation, said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least an axially spaced pair of first lateral sections extending from said first central section and a second lateral section extending laterally from said first central section in a direction opposite to said pair of first lateral sections, said first and said second lateral sections being axially offset from one another.

Preferably the aforesaid die element further includes a pair of said second lateral sections. Conveniently, multiple said pairs of the first and the second lateral sections of the work element engaging surface are provided extending from said central section whereby a first free space is located between adjacent said first lateral sections and a second free space is located between adjacent said second lateral sections. Preferably, each of the aforesaid first lateral sections has a uniform axial width. Similarly, each of the aforesaid second lateral sections may have a uniform axial width. In a preferred configuration the first and the second lateral extensions may be equal in width.

In a preferred embodiment, the or each said first free space may have a uniform axial width approximating but greater than an axial width of each said second lateral section. Conveniently, the or each said second free space has a uniform axial width approximating but greater than an axial width of each said first lateral section.

Conveniently, in one preferred arrangement, a pair of a said first lateral section and a said second lateral section are provided, the first lateral section in said pair being positioned axially relative to the second lateral section of said pair in one of:

(i) axially opposite one another;

(ii) axially offset relative to one another; or (iii) axially spaced from one another.

Preferably, the die element is configured whereby the work element engaging surface has no curvature in the axial direction.

According to a further aspect, the present invention provides a die element for a swaging or crimping press adapted, in use, to be moved radially inwardly during a swaging or crimping operation, said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least a pair of first lateral sections extending in a transverse direction from said first central section separated by a first space.

Preferably, the die element may have at least a pair of second lateral sections extending in a transverse direction opposite to said first lateral sections, a second space being defined between said pair or pairs of said second lateral sections. Conveniently, the or each said second space has an axial width equal to or greater than an axial width of a said first lateral section.

In accordance with a second aspect, the present invention also provides a die element configuration for a swaging or crimping press including at least two cooperating die elements that, in use, are radially moved inwardly during a swaging or crimping operation, each said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least a pair of axially spaced first lateral sections and at least one second lateral section extending in opposite transverse directions from said first central section, whereby a said first lateral section of a first said die element is located axially adjacent a said second lateral section of a second said die element in the die element configuration. Conveniently multiple said pairs of the first and the second lateral sections of the work element engaging surface are provided extending from the central section of each said die element.

The invention anticipates also providing a swaging or crimping press incorporating said die elements or said die element configurations in their assembly.

Preferred embodiments of the invention will be described hereafter with reference to the drawings.

DESCRIPTION OF PREFERRED EMBODIMENTS

Figure 1:
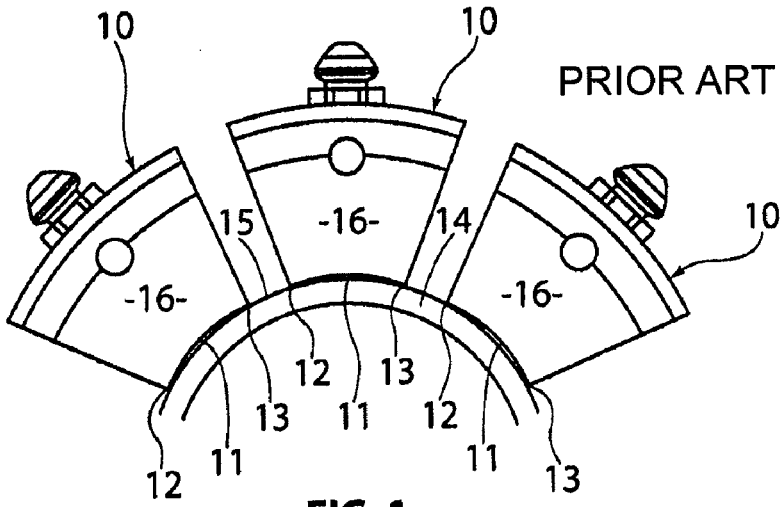
FIGS. 1 and 2 are schematic views showing some of the die elements of a conventional crimping or swaging press at the commencement of the crimping or swaging process acting on a work piece and subsequently at least part way through the crimping or swaging process.
Figure 2:
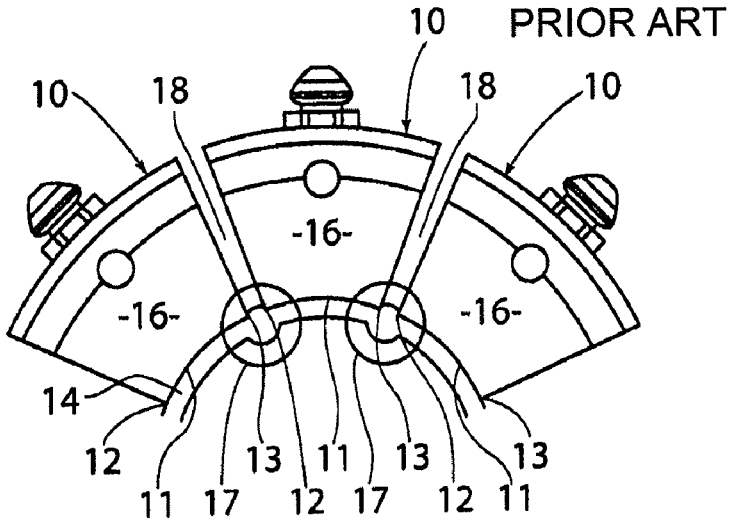

Referring first to FIGS. 1 and 2, a conventional crimping or swaging press is partially shown comprising die elements 10 having work engaging surfaces 11 that are transversely curved and axially straight. The lateral edges 12, 13 of the engaging surfaces 11 contact the work element (collar or ferrule) 14 first as the die elements move radially inwardly from the position shown in FIG. 1. Typically the remainder of the surfaces 11 do not contact the work element because of the mismatch in the curvatures of the work element engaging surfaces 11 and the outer surface 15 of the work element 14. As the bodies 16 of the die elements 10 move further radially inwardly, the metal of the work element 14 tends to balloon or bulge as shown at 17 in the regions 18 between the die elements 10. As discussed in the preceding, this is undesirable but to date has largely been accepted as a necessary disadvantage of conventional crimping or swaging machines.

Figure 3:
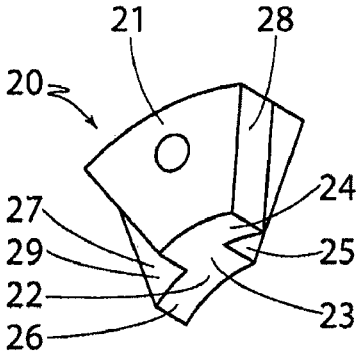
FIG. 3 shows in perspective view a first preferred embodiment of a die element according to the present invention.
Figure 4:
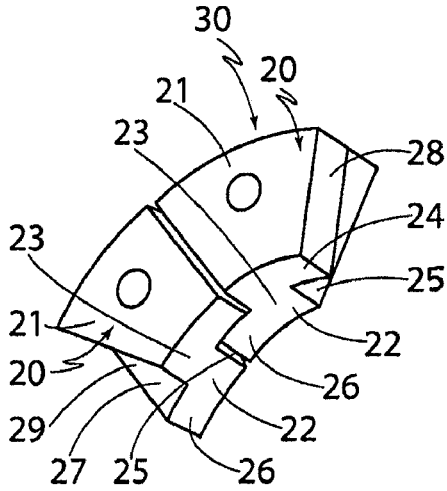
FIG. 4 shows two die elements as shown in FIG. 3 cooperating in a set of such die elements in a die element configuration.

Referring now to FIG. 3, a first preferred embodiment of a die element 20 according to the present invention is illustrated. The die element 20 has a body portion 21 and a radially inner work engagement surface 22. The surface 22 has a central portion 23 that extends preferably the axial length of the die element 20. The surface 22 may be concavely curved in a direction transverse (circumferential) to the axial direction and straight in the axial direction. The die element 20 further includes a first lateral section 24 extending in the circumferential direction from the central portion 23 of the work surface 22, and a second lateral section 26 extending oppositely to the first lateral section 24 from the central portion 23 of the work surface 22. The first and second lateral sections 24, 25 are conveniently offset axially from one another providing spaces 25 and 27 whereby in a configuration 30 (FIG. 4) of at least two such die elements 20, a said first lateral section 24 is positioned adjacent a second lateral section 26 whereby the parting line between the lateral sections 24, 26 includes a portion that is circumferential, that is it is not completely axial as in the prior art (FIGS. 1, 2). Each of the lateral sections 24, 26 is backed by a finger portion 28, 29 of the body portion 21 of the die element 20.

Figure 5:
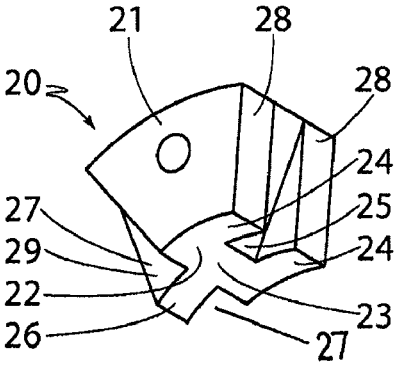
FIG. 5 shows in perspective view a further preferred embodiment of a die element according to the present invention.
Figure 6:
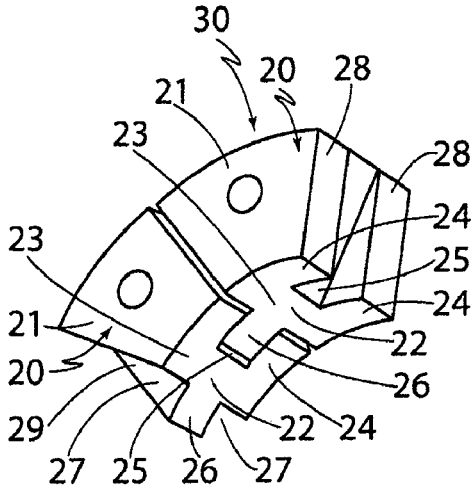
FIG. 6 shows two die elements as shown in FIG. 5 cooperating in a set of such die elements in a die element configuration.

Referring now to FIG. 5, a further preferred embodiment of a die element 20 according to the present invention is illustrated. The die element 20 has a body portion 21 and a work element engagement surface 22 on a radially inner side of the body portion 21. The surface 22 has a central portion 23 that extends preferably the axial length of the die element 20. Conveniently the surfaces 22 are curved concavely in a transverse or circumferential direction and are straight in the axial direction. The die element 20 further includes first lateral sections 24 extending laterally from the central portion 30, each of the lateral sections 24 being separated by a first space 25 and a second lateral section 26 extending laterally from the central portion 30 oppositely to the first lateral sections 24. Conveniently the width of the first space 25 is equal to or slightly greater than the width of the second lateral section 26 so that adjacent die elements 20 (FIG. 6) can be arranged in a die element configuration 30 with the first and the second lateral sections intermeshing in the axial direction. Conveniently, as illustrated, a finger portion 28, 29 of the body 21 of the die element also backs radially each of the first and second lateral surface sections 24, 26. The invention desirably has sections of the work engaging surface 22 from adjacent die elements 20 intermeshing axially rather than the die elements defining axial parting lines between the die elements as shown in FIGS. 1 and 2 (prior art).

Figure 7:
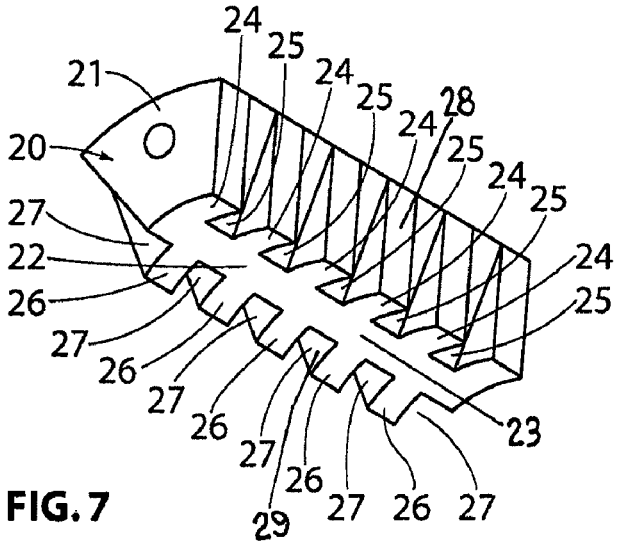
FIGS. 7 is a perspective view of a die element in accordance with a further preferred embodiment of the present invention.
Figure 8:
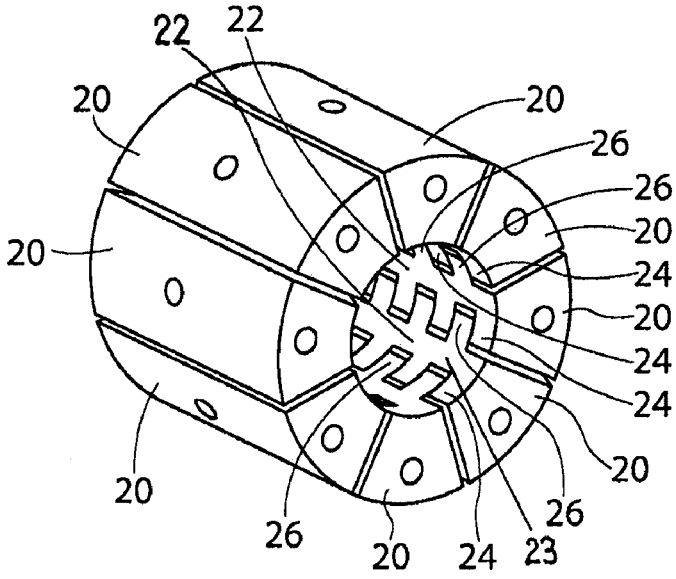
FIG. 8 is a perspective view of a die set including eight cooperating die elements as shown in FIG. 7.

FIGS. 7 and 8 illustrate a further preferred embodiment of a die element 20 according to the present invention (FIG. 7) and a die set configuration 30 of a number of such die elements 20 in a working arrangement (FIG. 8) in a swaging or crimping machine (not shown). Like features as described with reference to FIGS. 3 to 6 have been given the same reference numbers. In this embodiment, multiple first lateral sections 24 are provided extending from the central portion 23 of the work surface 22, each being spaced uniformly apart by first spaces 25. Similarly multiple second lateral sections 26 oppositely extending from the central portion 23 of the work surface 22 are provided, each being separated by a space 27. The spaces 27 and 25 are such as to allow the fingers 28, 29 of the body 21 supporting the lateral sections 24, 26 to be positioned therein as shown in FIG. 8 where eight such die elements cooperate in a use position in a crimping or swaging machine.

While FIGS. 3 to 8 show particular preferred embodiments of the present invention, many variations and modifications of the die elements 20 within the scope of the annexed claims may be made. It may, for example, be possible to provide die elements with only two (or more) first surface sections 24 spaced from one another which engage between second lateral surface sections 26 of an adjacent die element. While it is preferred that each die element in a set of die elements is the same, this is not necessarily essential to the present invention. The number of the die elements in a set of such die elements is also not critical and typically could be varied from 2 to 10 die elements in a set. The number of and the relative axial position of the laterally extending first and second surface sections 24, 26 is also not critical so long as in the assembled configuration of the die set (FIGS. 4, 6 and 8), the surface sections 24, 26 overlap or intermesh axially.

The invention claimed is:

1. A die element for a swaging or crimping press adapted, in use, to be moved radially inwardly during a swaging or crimping operation, said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least an axially spaced pair of first lateral sections extending from said first central section and a second lateral section extending laterally from said first central section in a direction opposite to said pair of first lateral sections, said first and said second lateral sections being axially offset from one another.

2. A die element according to claim 1 further including a pair of said second lateral sections.

3. A die element according to claim 2 wherein multiple said pairs of the first and the second lateral sections of the work element engaging surface are provided extending from said central section whereby a first free space is located between adjacent said first lateral sections and a second free space is located between adjacent said second lateral sections.

4. A die element according to claim 3 wherein each said first lateral section has a uniform axial width.

5. A die element according to claim 3 wherein each said second lateral section has a uniform axial width.

6. A die element according to claim 3 wherein the or each said first free space has a uniform axial width approximating but greater than an axial width of each said second lateral section.

7. A die element according to claim 3 wherein the or each said second free space has a uniform axial width approximating but greater than an axial width of each said first lateral section.

8. A die element according to claim 2 wherein a pair of a said first lateral section and a said second lateral section are provided, the first lateral section in said pair being positioned axially relative to the second lateral section of said pair in one of:

(i) axially opposite one another;

(ii) axially offset relative to one another; or (iii) axially spaced from one another.

9. A die element according to claim 1 wherein the work element engaging surface has no curvature in said axial direction.

10. A die element for a swaging or crimping press adapted, in use, to be moved radially inwardly during a swaging or crimping operation, said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least a pair of first lateral sections extending in a transverse direction from said first central section separated by a first space.

11. A die element according to claim 10 further including at least a pair of second lateral sections extending in a transverse direction opposite to said first lateral sections, a second space being defined between said pair or pairs of said second lateral sections.

12. A die element according to claim 11 wherein the or each said second space has an axial width equal to or greater than an axial width of a said first lateral section.

13. A die element configuration for a swaging or crimping press including at least two cooperating die elements that, in use, are radially moved inwardly during a swaging or crimping operation, each said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least a pair of axially spaced first lateral sections and at least one second lateral section extending in opposite transverse directions from said first central section, whereby a said first lateral section of a first said die element is located axially adjacent a said second lateral section of a second said die element in the die element configuration.

14. A die element configuration according to claim 13 wherein multiple said pairs of the first and the second lateral sections of the work element engaging surface are provided extending from the central section of each said die element.

15. A die element configuration according to claim 13 including two to sixteen, preferably eight, said die elements.

16. A swaging or crimping press including at least one die element adapted, in use, to be moved radially inwardly during a swaging or crimping operation, said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least an axially spaced pair of first lateral sections extending from said first central section and a second lateral section extending laterally from said first central section in a direction opposite to said pair of first lateral sections, said first and said second lateral sections being axially offset from one another.

17. A swaging or crimping press including at least two cooperating die elements that, in use, are radially moved inwardly during a swaging or crimping operation, each said die element including a body portion with a work element engaging surface located on said body portion, said work element engaging surface having an axial direction and a circumferential direction transverse to said axial direction, said work element engaging surface being concavely curved in said circumferential direction, said work engaging surface defining a first central section extending axially and at least a pair of axially spaced first lateral sections and at least one second lateral section extending in opposite transverse directions from said first central section, whereby a said first lateral section of a first said die element is located axially adjacent a said second lateral section of a second said die element in the die element configuration.

* * * * *